US010121457B2

(12) United States Patent
Gilbert

(10) Patent No.: US 10,121,457 B2
(45) Date of Patent: Nov. 6, 2018

(54) METHOD AND APPARATUS FOR WAKING-UP VIOLIN AND OTHER STRING INSTRUMENTS

(71) Applicant: John Gilbert, Pacifica, CA (US)

(72) Inventor: John Gilbert, Pacifica, CA (US)

(73) Assignee: John Gilbert, Pacifica, CA (US)

( * ) Notice: Subject to any disclaimer, the term of this patent is extended or adjusted under 35 U.S.C. 154(b) by 0 days.

(21) Appl. No.: 15/423,313

(22) Filed: Feb. 2, 2017

(65) Prior Publication Data

US 2018/0218715 A1 Aug. 2, 2018

(51) Int. Cl.
*G10H 3/00* (2006.01)
*G10D 1/00* (2006.01)

(52) U.S. Cl.
CPC ..... *G10D 1/005* (2013.01)

(58) Field of Classification Search
CPC ..... G10D 1/005
USPC ..... 84/723
See application file for complete search history.

(56) References Cited

U.S. PATENT DOCUMENTS 2,911,872 A * 11/1959 Wendel ..... G10D 3/00 84/10
5,031,501 A * 7/1991 Ashworth ..... G10D 3/00 84/723
5,537,908 A * 7/1996 Rabe ..... G10D 1/005 84/312 R
5,600,081 A * 2/1997 Simjian ..... G10D 1/005 84/294
6,320,113 B1 * 11/2001 Griffin ..... G10D 3/00 84/738
7,227,068 B1 * 6/2007 Van Doren ..... G10D 1/005 84/297 R
7,678,987 B2 * 3/2010 Lye ..... G10D 1/005 84/294
7,932,457 B2 * 4/2011 Hall ..... G10D 1/005 84/600
7,977,555 B2 * 7/2011 Hall ..... G10D 1/005 84/291
7,977,565 B1 * 7/2011 Lye ..... G10D 1/005 84/294
8,134,064 B2 * 3/2012 Sanns, Jr. ..... G10H 3/18 84/453
8,642,877 B1 * 2/2014 Blish ..... G10D 1/005 84/453
8,662,245 B1 * 3/2014 Hall ..... G10D 1/005 181/198
2007/0175320 A1 * 8/2007 Hall ..... G10D 1/005 84/723
2008/0289483 A1 * 11/2008 Hall ..... G10D 1/005 84/723
2009/0229445 A1 * 9/2009 Courtright ..... G10D 1/005 84/453

(Continued)

*Primary Examiner* — Jeffrey Donels

(57) ABSTRACT

Waking-up a violin or other instrument by determining naturally resonating features of a particular instrument by applying tones and analyzing the instrument's responses, and then applying vibrations (e.g., continuously and/or in patterns, such as alternating on/off, staccato, etc.) corresponding to the most responsive (resonant) portions of the instrument's responses (e.g., peaks of the analyzed instrument's response) fully breaking in the various parts of the instrument. The applied vibrations are continued until the instrument's amplitude response plateaus.

23 Claims, 7 Drawing Sheets

(56) References Cited

U.S. PATENT DOCUMENTS

| | | | | |
|---|---|---|---|---|
| 2009/0293707 | A1* | 12/2009 | Suhr | G10D 1/005 84/723 |
| 2011/0167991 | A1* | 7/2011 | Sanns, Jr. | G10H 3/18 84/723 |
| 2014/0144305 | A1* | 5/2014 | Hellinge | G10D 3/06 84/290 |

* cited by examiner

300

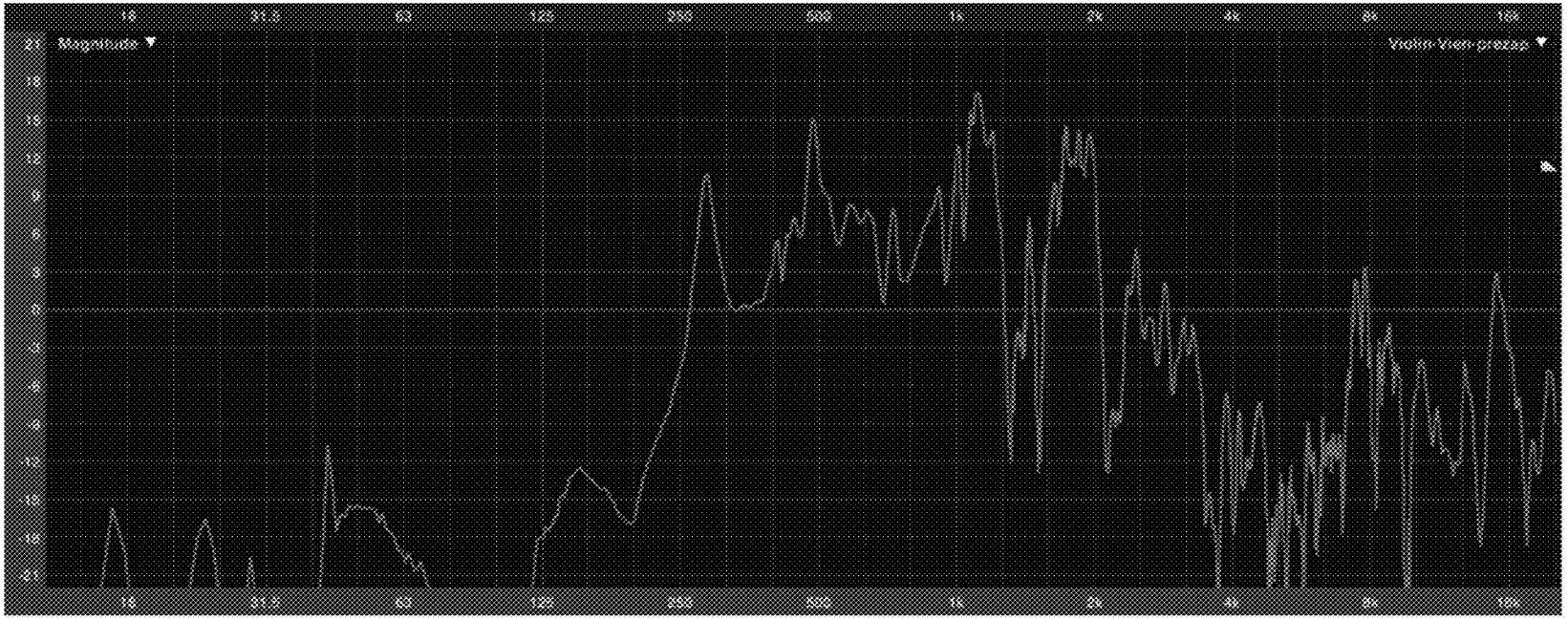
Magnitude
Proton-Proton (p-p)ZZ
0
0.2
0.4
0.6
0.8
1
1.2
1.4
1.6
1.8
2
2.2
2.4
2.6
2.8
3
3.2
3.4
3.6
3.8
4
4.2
4.4
4.6
4.8
5
5.2
5.4
5.6
5.8
6
6.2
6.4
6.6
6.8
7
7.2
7.4
7.6
7.8

METHOD AND APPARATUS FOR WAKING-UP VIOLIN AND OTHER STRING INSTRUMENTS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Field of Invention

The present invention relates to the break-in and "waking-up" of bowed string instruments. The methods, processes, and apparatus described herein may be applied to, for example, violin, viola, cello, and bass instruments. However, the invention is not limited thereto and the skilled artisan will understand that the same may be applied to many other instruments and acoustical devices having similar resonate qualities.

Discussion of Background

Bow Stringed Instruments (BSI), especially newly constructed and those that have not been played for considerable lengths of time, typically lose or otherwise fail to achieve the full harmonic and amplitude response that the instrument is capable. Typically, musicians play new and old instruments for lengths of time (often months, or even years) during which they typically begin to wake-up—causing the sound and tonal qualities of the instrument to improve. Some mechanical means are available to assist in the wake-up process, but musicians and luthiers generally agree that playing the instrument is the best method to achieve what is considered the instrument's best sound, and is usually considered necessary regardless of the wake-up (or break-in) process utilized.

Each instrument even of a same design from a same manufacturer and of similar material, although in some cases may be very similar, will have its own unique qualities. These unique qualities can affect even the highly skilled musician/luthier's ability to determine the break-in status of an instrument. Most instruments never attain a status of being fully awake.

SUMMARY OF THE INVENTION

The present inventor has invented a new method, process, and apparatus for waking-up a violin (and other string instruments). The present invention includes fully breaking-in an instrument and performance tuning it in a manner that takes advantage of its capabilities, and particularly it broken-in status. In one embodiment, the method comprises determining a natural response of a particular instrument and applying vibration to the instrument that matches or otherwise corresponds to peaks in the natural response.

An apparatus according to the present invention includes, for example a sound analyzer capable of detecting peaks and valleys in a frequency response of an instrument. The frequency response provides a roadmap illustrating a natural resonance of the instrument, its peaks (peak frequencies) illustrating points where the instrument's construction and material have a natural harmonic response—frequencies at which the instrument will have a greater amplitude response, frequencies where the instrument is able to more fully resonate.

The apparatus further comprises a bridge vibrator or other mechanism with which to apply wake-up tones or otherwise cause the instrument to play at and around the specific peak frequencies within its natural response.

The process is, for example, detecting peak frequencies of an instrument and then applying peak frequencies to the instrument. The present inventor has applied the process to violins and violas ranging from $200 imports to century old masterpieces, and each has responded at a scale that raises the sound quality at an order of magnitude greater than what would be expected from the instrument. When combined with a full rebuild insuring the instruments components are solidly interacting and bridge tuning, each instrument plays at a quality level well beyond expectations for its class.

The present invention includes a set-up/tuning of the instrument's components. Such set-up/tuning enhances activation of the natural resonances of the instrument. The set-up/tuning process includes tuning the instruments parts (tuning, rebuilding, or setting-up the individual parts), assuring the individual parts have proper contact to other parts of the instrument. The present invention may then proceed to determining the natural frequency peaks of the instrument. Vibrations are applied at frequencies corresponding to the peaks. Playing the instrument for a short while can then complete the break-in process. The result is a wake-up process that can be completed in less than 2 days and reach a level of performance that might otherwise not have been possible even if the instrument had been played heavily for many years.

The present invention is embodied as a device which may include an electronic device attached to the instrument that applies vibrations to an instrument, determines peak frequencies and simultaneously or nearly simultaneously or at a later time applies vibration (e.g., a bridge vibrator device) at or near the peak frequencies for a predetermined amount of time (or amounts of time at or near the various peak frequencies).

Portions of both the device and method may be conveniently implemented in programming on a general purpose computer, or networked computers, and the results such as peak frequencies or their equivalents (e.g., nearby frequencies) are transmitted (and may be displayed) to a vibrating device used to on an flex or vibrate the instrument. The results and computations and/or control of a frequency counter or other listening device (e.g., frequency analyzer) for determining peak frequencies (or their equivalents) and a vibrating device (such as a bridge vibrator) may be connected to any of the general purpose, networked computers (e.g., connected over the internet), or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable(s), and co-ax cable(s), etc.

The present invention includes the use of an instrument that has been tuned and/or woken-up via any of the processes or use of devices according to the present invention. The present invention includes a performance characterized by one or more "old" violins that have fallen into a state of hibernation (instruments that are not awake), wakening the instruments according to any of the processes of the present invention (especially by determining peak frequencies and applying corresponding tones/vibrations), and then performing the concert.

The present invention includes applying any of the processes or devices of the present invention in the manufacture of new or rebuilt instruments. Although preferably applied to classic instruments that are not performing at or near their maximum potential, in one embodiment, the present invention is applied to mass produced or other new instruments.

The present invention includes a new instrument that has plateaued. A plateaued instrument is one that can be subjected to break-in vibrations and exhibit no further response changes. The present invention includes the production of mass-produced instruments that have plateaued, and any mass produced instrument that has plateaued (or that has partially plateaued due to a less than complete break-in process). The mass produced instruments may be plateaued at individual frequencies specific to each mass produced instrument, which more strictly adheres to the processes described herein, or to a set of frequencies selected as closely matching the instrument's fundamental design, material quality, and manufacturing process (i.e., frequencies most likely to be resonant based on past experiences with the same design, material quality, and manufacturing process). The present invention includes any new, mass produced, or luthier produced (or altered or repaired) subjected to vibrations or tones in a manner causing break-in or positive alteration of the instruments amplitude response (resulting, for example, in a plateaued or partially plateaued instrument). The present invention includes any new, second hand, mass produced, or luthier produced (or altered or repaired) instrument subjected to any of the processes described herein or any derivatives thereof.

The present invention includes installation of equipment and/or processes in a factory that makes new violins (or other instruments). For example, in a production line for making student violins, a position for measuring a frequency response of the violin and applying peak frequencies as determined by the measured frequency response to the instrument for a predetermined amount of time or until a predetermined amount of change occurs in the tonal quality of the instrument. The present invention includes retrofitting a factor currently making mass produced instrument with any process according to the present invention. The present invention includes adding a break-in process to a mass production facility. In other embodiments, the present invention is applied to instruments that have not been played for years, decades, or in some cases even centuries.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3B is an illustration of a transfer function of the viola referenced in FIG. 3A after break-in.

FIG. 5A is a chart of a measured response of a newly manufactured violin prior to application of the present invention.

DESCRIPTION OF THE PREFERRED EMBODIMENTS

Figure 1:
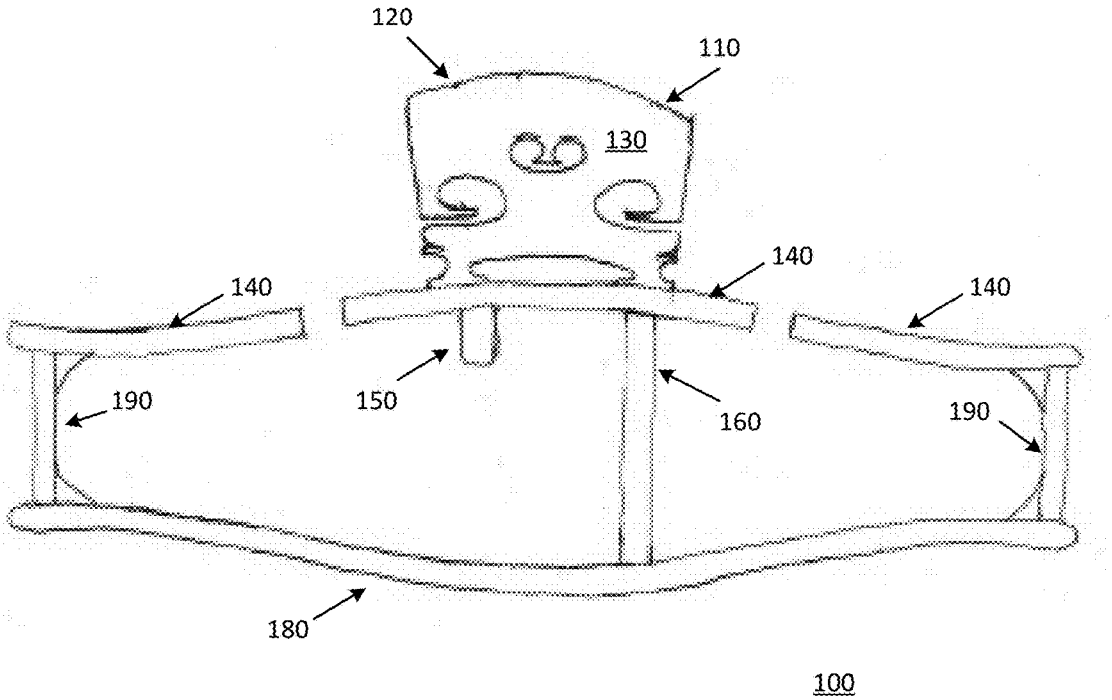
FIG. 1 is a drawing of components of a Bow String Instrument (BSI)

Referring now to the drawings, wherein like reference numerals designate identical or corresponding parts, and more particularly to FIG. 1 thereof, there is illustrated an exemplary Bow String Instrument (BSI) cross section 100. Parts shown are High string 110 (E for violin, A on viola or cello), Low String 120 (G for violin, C on viola or cello), Bridge 130, Top Plate 140, Bass Bar (runs same direction as strings) 150, Sound Post 160. Bottom Plate 180. Sides or ribs (with lining as edge supports around top and bottom plates) 190. The gaps in the top plate are due to the F holes on each side of the bridge.

Bowed String Instruments (BSI) are violins, violas, cellos, basses, and any other instruments that have #1—a bridge (e.g., bridge 130) that converts primarily horizontal vibrations created by strings (as driven by a bow) into primarily rocking motion of the middle of a top plate, and #2—a sound post (e.g., sound post 160) underneath the high string side of the top plate that transfers part of the vibration energy on the top plate into a vertical motion of the bottom plate. For the purposes of the present invention, a BSI need not conform directly to these specifications, and, although directly mainly to the traditional instruments so defined, the invention specifically includes most variations of essentially all acoustical instruments and especially instruments constructed similarly or having similar qualities of the traditional BSI.

One problem associated with breaking in a BSI is that very few BSIs "in the wild" [in general circulation] are broken in, and even those that are considered broken in (or awake) may not be fully broken in or fully awake. It has been found that many instruments, even ones played on extensively, still have considerable room for further improvement in break-in—it's possible that playing alone is not able to cause complete break-in. Complicating the break-in process is that there are a number of layers of break-in—all of which play a part in allowing a BSI to function properly. One of these layers, the back plate (e.g., FIG. 1, back plate 7), is particularly difficult to break in using any traditional or published methods. The back plate of a BSI is usually made from aged hard maple which by design and intent is much harder to flex than the front plate (e.g. FIG. 1, front plate 4) which is usually made from spruce. This results in most BSI only able to use the front plate to create sound, and a large amount of energy going into the instrument being absorbed rather than converted to sound. Traditionally it takes years, perhaps even decades of intense playing before an instrument starts "waking up". This is probably the primary reason that new instruments are almost universally considered inferior to old instruments.

With the present invention, this initial break-in process can be shortened to less than one day for new instruments. The invention further and enables secondary and further break-in processes to happen.

By way of the present invention, a properly broken in instrument results in the back plate of the instrument moving to a greater degree which generates more volume, primarily in the lower frequencies where more air needs to be moved.

Even a very small increase in movement of such a relatively large part of the instrument that was virtually still prior to break-in results in a relatively large and positive response in the instrument as a whole. Further, the back plate and secondarily the top plate and other resonant components of the BSI becoming more elastic—making those parts better able to transfer vibrations to other regions rather than to absorb them. This increases the harmonic content of sounds produced, increases the volume or usable dynamic range, and speeds up the output tone response time from an input signal (time from a bow movement across the string to producing a stable tone).

In one embodiment, the present invention performs a measurement of the BSI using an input signal generated by a signal generator coupled or attached to the BSI. The signal generator may be attached at the bridge. The signal generator may be a Bridge Vibrator (BV) installed, for example, per manufacturer's instructions, and the resulting sound output from the BSI is captured with a microphone and processed by a spectrum analyzer (e.g., frequency analyzer). A spectrum or frequency analyzer will typically provide an output which may be displayed, printed, or passed on to storage or provided as an input to other processing or analysis programs or processes according to the present invention, equivalents, or other processes utilizing the same type of frequency data provided by the analyzer.

The output from the spectrum analyzer represents the overall response of the BSI. The output from the spectrum analyzer is reviewed or analyzed to determine peaks where the BSI has a favorable response. Although the invention is not limited thereto, in the main embodiments discussed herein, the peaks of primary interest pertain to the back plate and are in the lower frequencies emanating from the BSI.

The output, resulting information from the spectrum analysis is used to generate a set of break-in tones (at, near or corresponding to the peaks [e.g., a predetermined percentage of the peaks]) that are optimal for the measured BSI. These tones are then sent to the BSI through the BV at a maximum measured level that the BSI can handle (determined as described below) and monitored using a sound level meter or dB meter. Once the sound level for each of the selected tones has risen to a stable level (i.e., the instrument has plateaued), the BV break-in process for that BSI is done. This finishes the primary break-in (bottom plate), which enables the secondary (top plate rocking) break-in to take place.

The secondary break-in is performed with a horizontal driving motion (The BV is generally not suitable for secondary break-in because, as typically installed, generates a more vertical motion), which can be accomplished with about twenty minutes of playing the instrument with a bow. Once this secondary break-in has happened—the instrument can be performance tuned. The present inventor has observed multiple tertiary break-in mechanisms, and the instrument—if played regularly—will further mature over time with use to become even better sounding.

The inventor has found that this secondary and tertiary break-in time frame applies even if the BSI has been played heavily for years before being broken-in according to the present invention (the primary break-in point). This process works for new instruments as well as older instruments (100 or more years since construction)—the older instruments have been observed to take longer to break-in, apparently due to the increased toughness of the wood as it has aged, but, in the inventor's experience, has also yielded even more dramatic a transformation.

BV units are commercially available, The inventor has had very good success with 10-Watt units from bridgevibrator.com—violinbroker@gmail.com—lesser power handling units tend to come apart or burn out too quickly to be useful, as they typically were not designed for such intense usage.

An exemplary tool and resource list comprises:

1. Bridge Vibrator (prefer 10 W or greater).
2. Felt Strip to wrap and dampen strings.
3. Tie or other mechanism (e.g., prefer Velcro Cable Tie) to hold the BV onto BSI.
4. Amplifier (50Watt or greater preferred).
5. Signal Generator (prefer iPad Nano, or other programmable signal generator).
6. BSI stand.
7. Cooling devices (e.g., Fan to keep BV and Amp cool).
8. Room where noise is tolerated.
9. Audio Analyzer (prefer computer with audio analysis software or stand-alone signal analyzer). Preferably including a windowed transfer function or spectrum analysis.
10. Appropriate interfaces (e.g. Digital to Analog/Analog to Digital interface).
11. Microphone with stand.
12. Microphone pre-amp—phantom power source if needed by microphone.
13. dB or loudness meter.
14. Cables (microphone, analyzer, BV, as needed for data, power, etc.)
15. A bowed string instrument to break in.

The skilled artisan will understand that equivalents exist for each of the items listed above, and some components may not be necessary with the application of relatively small amounts of additional ingenuity and that various substitutions are easily made. The above list provides only one example of equipment useful for implementing a BVI instrument break-in according to several embodiments of the present invention.

Bridge and SoundPost Pre-Process

Bridge Angle

Having a bridge at the bisect of the angle of the strings is worthwhile as this insures that the bridge is underneath and generally perpendicular to the forces created by the BV unit. The bridge is, for example exactly at the bisect angle of the strings and the bridge is directly under and perpendicular to the forces created by the BV unit during break-in.

However, having a bridge that is exactly 90 degrees to the top of the instrument as described by most violin making books has been found to be incorrect and can result in the bridge slipping out from underneath the BV unit. This may be compensated for, for example, with use of wax. The longevity of the bridge is also an issue with the traditional way, with many bridges bending over time due to the string forces not aligning with the bridge's maximum compression strength direction. The effect on the resulting sound and performance seems to be minimal but remains to be studied.

Figure 2:
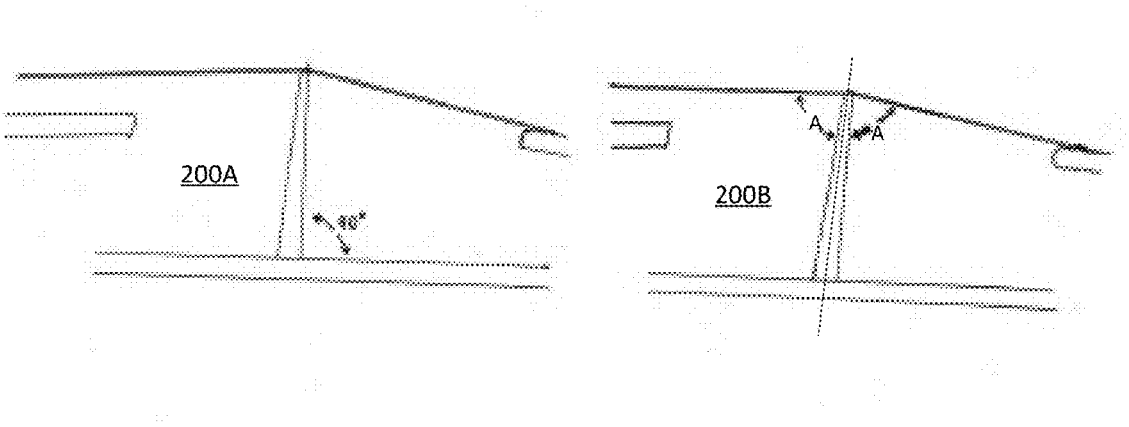
FIG. 2 is an illustration of bridge angle, 200A being a 90 degree method, and 200B being a recommended angle bisect method.

Referring now to FIG. 2, an illustration of bridge angle is shown. 200A is a drawing of the traditional 90 degree method, and 200B is the newer and recommended angle bisect method. The diagonal dotted line represents the resulting compression force applied on the bridge from the strings.

Bridge Feet and Sound Post Ends

The best configurations eliminate air gaps underneath the bridge feet and between the sound post ends and the plates. [upper and lower] Preferably, there are no air gaps underneath the bridge feet, or between the sound post ends and the plates. That there is a solid connection for vibration transfer through the entire system for the break-in methods described herein to work properly. Having a bridge with improperly carved feet, or a sound post with one or more wrong angles can permanently damage the instrument especially during the break-in process described herein.

Measurement Phase

Setup—Hardware

A reference microphone is positioned to pick up vibrations/tones emanating from the BSI to be measured. The reference microphone (preferably one of flat or known frequency response) may be mounted on a microphone stand at a repeatable distance and position from the BSI to be measured. The BSI may be set up on an instrument stand. The exact position isn't critical, as the relative frequency balance doesn't change much over distance and angle over the appropriate range, and only serves as a data point to compare to other BSI under similar measurement conditions [or the same BSI with varying stimuli applied]. A dB meter may also be positioned to measure dB level of the BSI to be measured. The dB meter may be mounted similarly as described for the microphone.

The microphone is coupled to a recording, other capture mechanism, or an analysis device. The microphone may be a handheld device with a suitably sensitive and dynamic range microphone built-in such as a smart phone with an appropriate app to capture and process the sound according to the present invention, or merely capture and pass on to another processing device such as a desktop computer, or a cloud based service (which may also be receiving information from the dB meter) for full analysis and/or monitoring and/or adjustment of the break-in process.

In one embodiment, the microphone and a microphone pre-amp is coupled (wired or wirelessly) to an analog to digital (AD) converter and computer. It's possible but not required to similarly attach the dB meter (the dB meter provides loudness information) which allows the computer to automatically monitor and adjust the break-in process. The microphone with appropriate software can function as a dB meter.

A vibrating device is attached to the BSI. A BV may attached to the BSI. The BV may be attached to the BSI by attaching it to the bridge. The present inventor has made this attachment and been most successful in keeping the BV mounted to the bridge as it's working [vibrating] by wrapping a 1"×6" felt strip around the strings right above the bridge (towards the fingerboard), then wrapping a Velcro strap around that and the mounting post that's part of the BV. [Picture] The BV is plugged into an amplifier that is then connected to a Digital to Analog (DA) converter and the computer. All of this allows the computer to send a signal to the amp and BV, and simultaneously record the sound coming back (via the microphone) from the BSI.

The skilled artisan will understand many options for placement and routing of microphones and sending of data to an app, computer, networked computer, or cloud based service. The present inventor uses a DA/AD interface known as the M-Audio M-Track Plus, which the inventor has found to work well with a laptop computer. The M-Audio M-Track Plus is low cost and provides phantom power/microphone preamp all off a USB connection making it very portable. If cost is less of an issue, the rack-mount RME FireFace 800 or equivalent works very well.

A fan is used to blow across the BV and amplifier for cooling, which allows the BV to be run with greater amplitude and duration than without.

Setup—Software

One way to extract the needed information from the above setup is to use Smaart V7, which has a windowed transfer function analysis component and signal generation built in. [with signal generation built-in] With Smaart V7, measurements are made very quickly providing the response of the instrument in real time via an impulse time window which eliminates the effect of reflections and room modes.

Audacity can be used for similar results—not nearly as precise but it's no cost and easily available. The process is to create a track in Audacity that plays a generated pink noise track, while recording from the microphone—make sure that live monitoring is off so that microphone sounds don't mix back into the output or else you may get runaway feedback. Pink noise contains equal amounts of energy per octave, so by running the plot spectrum function on the resulting recording, a logarithmically friendly graph of what noises managed to get through DA->Amp->BV->BSI->Microphone->MicAmp->AD system are provided. As most of that chain has a flat frequency response—it's safe to say that the BSI response is almost entirely responsible for the peaks and valleys found on the graph.

Data Analysis

Early in this process, the inventor had many ideas about ideal tones to maximize the break-in process, and just as many questions about its mechanisms and limits. After many months and dozens of tests, patterns have emerged.

1. Using the above setup in-between "break-in" sessions allows repeatable response measurements, even days and weeks apart in different test environments.

2. Low frequency (below around 500 Hz) tones have the most impact and are namely the back plate break-in. In fact higher frequencies at this stage of the break-in process seem to make little if any measurable effect.

3. For any frequency response functional zone there's a physical limit to how much the instrument is capable of moving, once that maximum is hit—no amount of energy spent in that zone or time spent "pushing" on that region changes its response in any measurable [meaningful] way.

4. If the instrument doesn't seem to respond to an input signal in a frequency zone, using tones selected to exercise that zone have little result. The fastest and greatest response is found when pushing on zones [applying frequencies that] the instrument already responds to.

5. There doesn't seem to be any measurable difference in the end result as to what kind of tones were used to get there. This seems to counter the adage that an instrument somehow responds different if it's played in tune, but perhaps once it's fully broken-in there is no more room for improvement. [check] Tuned noise as described below works well, and is not unpleasant to be around, unlike saw tooth waves and white noise that contain "harsh" high frequency elements.

6. It doesn't seem to be possible to over break-in an instrument over a reasonable time frame. Instruments left on a BV running for more than three weeks past their measured break-in plateau (usually hit within 24 hours) have not shown any measurable differences as either disadvantages or advantages.

Figure 3A:
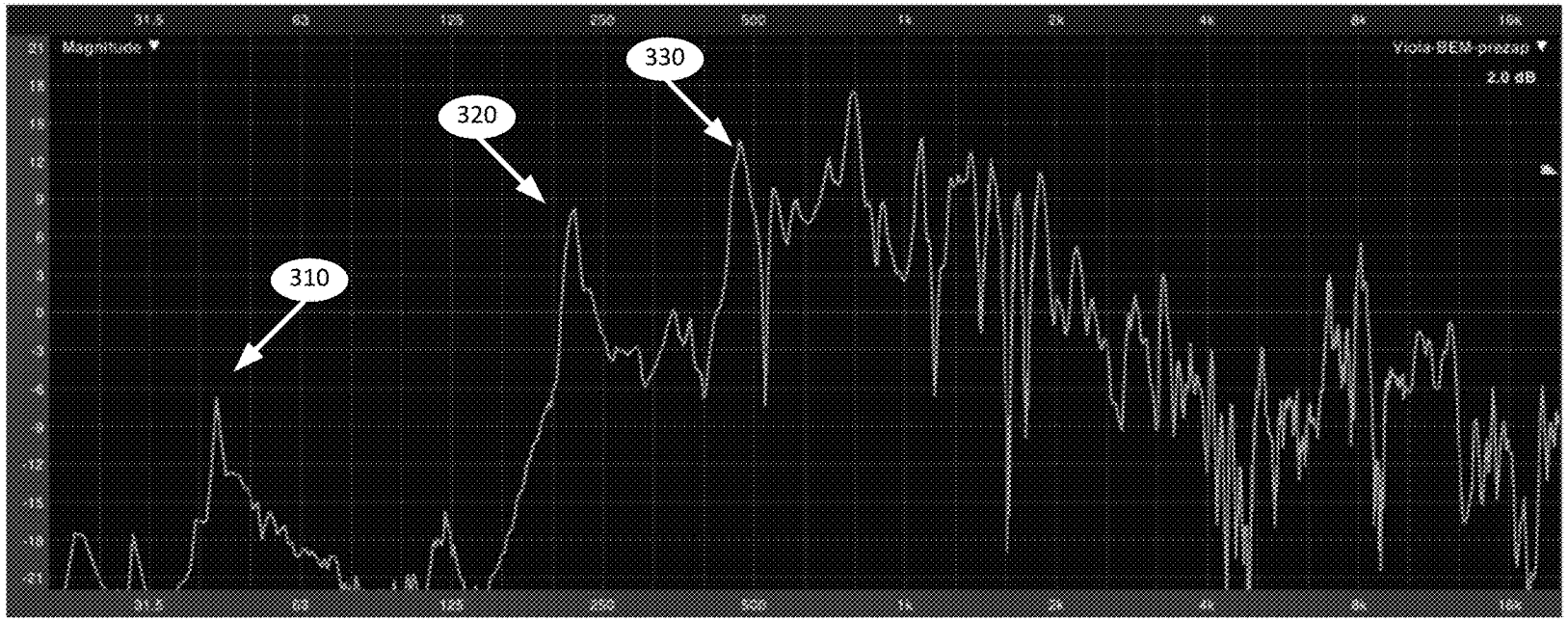
FIG. 3A is an illustration of a transfer function of a viola before the break-in process has begun.

FIG. 3A is an illustration of a transfer function 300 resulting from a viola before the break-in process has begun. There are very pronounced peaks around 50 Hz (310), 250 Hz (320) and 440 Hz (330). The inventor has found that focusing the break-in effort around these zones will have the fastest response. Each instrument will have its own optimal zones that work best.

Figure 3B:
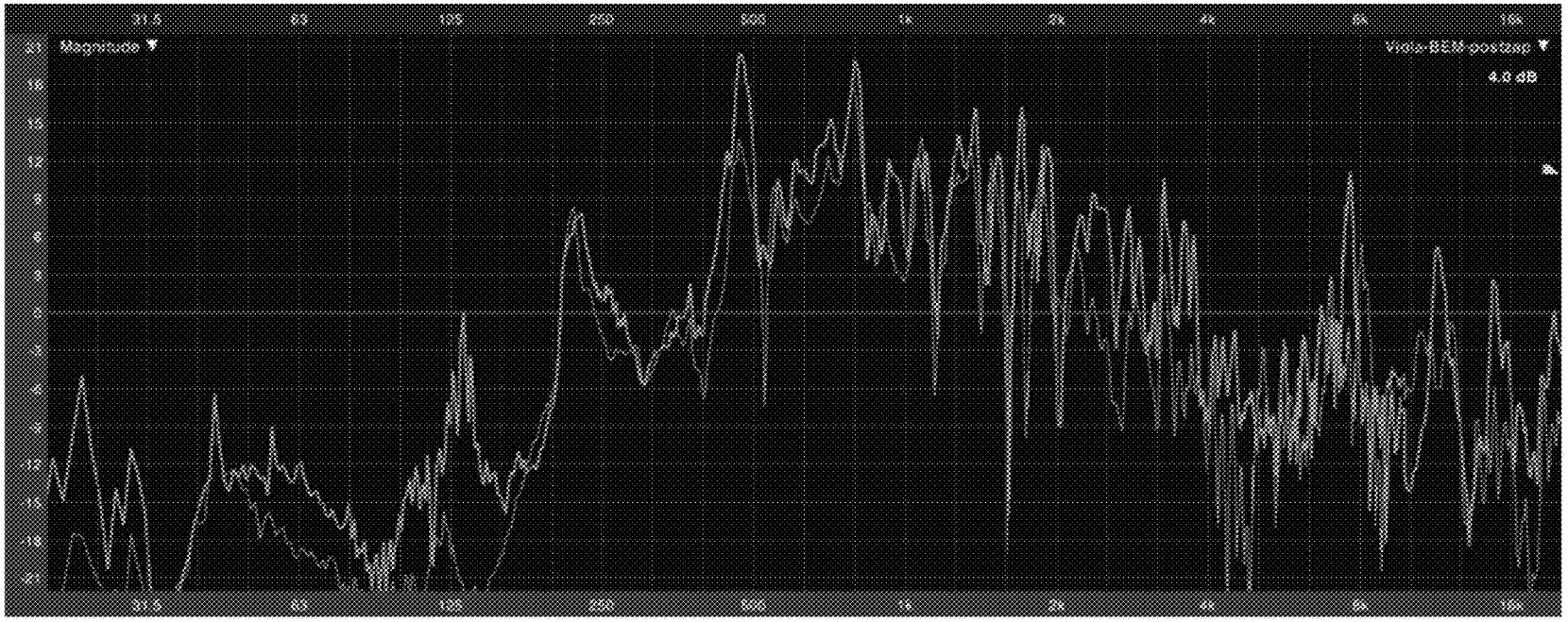

Upon completion of the process according to the present invention, the BSI exhibits increased fidelity and increased volume for a similar pre-process stimuli. For the viola mentioned in FIG. 3A, the result is shown in FIG. 3B (overriding the original pre-process response). As shown in FIG. 3B, the result (response) is the lighter graph and is generally higher than the original pre-process response representing a greater amount of sound output from the instrument for the same energy/effort input to the instrument.

Audacity Recipes for break-in tones—tuned noise example.

For each peak selected note the frequency, generate one or more minutes of pink noise, than run a high pass filter (48 dB/octave) at the selected frequency, then a low pass filter (48 dB/octave) at the selected frequency, then normalize to 0 dB. It's a good idea to do a fade out over the last few samples so it doesn't pop when the track finishes. All of this can easily be done with Audacity with the LADSPA plugins, or other full featured audio editing tools.

After exporting wav files for each of the selected frequencies, load them onto a music player (like an iPod). It's not a good idea to convert them to MP3, as this will remove a lot of the spectral content of those files making them less effective. "wav", or other lossless audio format is best.

Level Setting, Cooling, and Buzz Hunting

If possible, you want to run this process at the greatest amplitude that the instrument can handle. It's very obvious when it's set too high as the instrument will periodically pop and chirp, which is very distinct from the low rumble that you get when the level is set below the proper threshold. After a few hours of running the instrument can usually handle a little bit more signal than at the start, and the resulting sound output level from the same input signal goes up as well. This can be measured with a dB meter. Usually after less than 24 hours for a new instrument, the output level changes plateau, it can be a few more days up to a week before this happens with older instruments.

It's a good idea to monitor the instrument periodically for the first few hours and listen carefully for any buzzing or rattling, as this can be a sign of something wrong with the instrument. By doing this process we are asking the instrument to move in ways it hasn't before, and by design if over stressed the instrument will start coming apart at the seams rather than crack or break. This is fixable by a luthier and fortunately rarely happens. The process also exposes loose bass bars, chin rests that are no on tight enough, sound post too short, and other issues that should be addressed before continuing the break-in process.

Break-in Phase Notes

It's recommended to drive this with an iPod or other music playback system rather than a general purpose computer, as computers tend to not be the most reliable running audio over long periods. See note above about not using MP3 or other lossy compression though.

Post Break-in Notes

Instruments that have been broken-in with this process are immediately different than they were before, but are actually only at the beginning of their over-all break-in. The present inventor has identified a few separate break-in mechanisms so far, where the back plate is just the first.

There is a very minor bridge-string interface break-in phase which can be done in less than a minute, as this occurs only with brand new bridges. If you pluck the strings with a pick, the strings can sound dampened but in just a minute after just a few plucks become more resonant. This strongly effects the string-string interactions through the bridge where you play a note on one string that is an octave away from a nearby string.

The next very strong break-in phase is the top plate rocking motion break-in which seems to take about fifteen to twenty minutes of playing with a bow to fully open up. An un-broken-in instrument's top plate pivots around the top of the sound-post, as the bottom plate strongly resists movement. On a freshly broken-in bottom plate—the instrument has to find a new center of movement between the bass bar and bottom plate. The instrument goes from a kind of tinny harsh sound to a more open and louder baser sound in this first twenty minutes of playing. It's only after this point that the inventor recommends performance tuning the bridge and perhaps moving the sound post a little further from the bridge for an even more full sound.

The final break-in phase seems to take many months even with heavy use. The break-in process effects the various parts of the instrument that end up becoming more elastic, vibrations from playing rather than being absorbed are passed along into parts of the instrument responsible for more complex and subtle harmonic modes. The bulk of the tonal and loudness improvement is from the back plate and rocking break-in, this last phase is more subtle.

The present invention includes use of a microphone, bridge vibration unit, signal generator and spectrum analysis software to determine the specific pre-existing vibration response of the back plates of a bowed string instrument.

The present invention includes use of specific instrument response to determine optimal break-in frequency ranges.

The present invention includes use of band limited noise (tuned noise) or tones in specific frequency ranges to excite the instrument for rapid break-in.

The present invention includes use of sound level meter to monitor break-in process and automate detection of when that stage is complete.

The present invention includes use of a real-time spectrum analyzer to adaptively set the optimal signal level to always be just below the popping threshold. This also can be used to monitor when instrument has completed this break-in phase.

In one embodiment, the present invention comprises a method, comprising the steps of selecting an instrument, securing the instrument and attaching at least one vibrating device to the instrument, locating a microphone near the instrument (e.g., at an opening of a top plate, within 1 meter of the instrument, etc.), applying a vibration through the vibrating device (e.g., bridge vibrator, sonic transducer, etc.), measuring a response (wherein the response is measured by recording through the microphone frequencies emitted by the instrument when vibrated, analyzing the measured response and identifying peaks, applying vibrations corresponding to the peaks until a response to the peak corresponding vibrations is stable.

The peaks may be identified, for example, as areas of the measured response that rise a predetermined amount above a moving (or local) average of the measured response. The moving average may be, for example a 50 Hz moving average.

The moving average may be, for example a 50 Hz, or approximately a 50 Hz moving average. The moving average may be, for example a 100 Hz, or approximately a 100 Hz moving average. The moving average may be, for example a 150 Hz or approximately 150 Hz moving average. The moving average may be, for example a 200 Hz or approximately 200 Hz moving average. The moving average may be, for example a 250 Hz or approximately 250 Hz moving average. The moving average may be, for example a 500 Hz or approximately 500 Hz moving average.

In one embodiment, the peaks are determined by comparing the instrument's response at a given frequency with a smoothed curve of the measured response. Where the instrument's response is above the smoothed curve by a predetermined amount, a peak is noted. The predetermined amount may be in dB or by percentage. The predetermined amount may be any of 1 dB, 2 dB, 5 dB, or 10 dB. The predetermined amount may be 1%, 2%, 5%, 10% above the smoothed curve.

In one embodiment, the peaks are determined by identifying a relatively small area bounded by a positive and negative slopes within the measured response. The peaks may be determined by predetermined area size and/or predetermined slopes, and/or predetermined slope (i.e., a "peak" may be identified at an inflection point preceded by a "steep" positive slope which then suddenly plateaus or decreases in positive slope without a corresponding negative slope). The present invention includes identifying "peaks" at inflection points in the measured response.

In one embodiment, all of the peaks in the instrument's response are identified and corresponding frequencies are utilized for break-in vibrations. In one embodiment, the top 3 or 4 peaks are selected below a target sequence for use in break-in vibrations. That is, frequencies corresponding to the top 3 or 4 peaks are applied to the instrument to effect break-in (or wake-up) of the instrument.

When an instrument has two or three well defined peaks it is a simple matter of performing the break-in at those corresponding frequencies. When an instrument exhibits many peaks, various methods may be applied for selecting the top peaks. For example, selecting peaks with the steepest slopes (rising and/or falling slopes, percentages over average(s), dB over average(s), etc.) Further, the "peaks" are not necessarily peaks but may be inflection points or other interesting features in the response (e.g., a pattern of dips, a waveform or anything out of the ordinary or average).

The response of the instrument and identification of peaks may be observed by the luthier by feeding the response (from a microphone) into a computer (or other processor, smart phone, analyzer, etc.) with a computer program for recording and/or rendering frequency responses. For example a computer with audacity installed, or other audio analysis/spectrum analyzer software (Adobe Audition and/or Rational Acoustics Smaart are additional possibilities).

The peak(s) utilized for break-in may be the peak of a local area of the frequency response, and the break-in tone itself may be the peak frequency, close to the peak frequency, an application of a tone within 10% of the peak frequency. In one embodiment, the present invention applies a closest natural note frequency (or natural string frequency) to a peak. In one embodiment, the peak and a next higher natural note and next lower natural note are all applied as break-in frequencies.

The present invention includes applying a break-in frequency to an instrument, wherein the break-in frequency corresponds to a natural frequency response of the instrument.

The present invention applies vibrations to an instrument (or other acoustical device) to both determine frequency responses of the instrument (e.g., where the instrument naturally responds better compared to most other frequencies), and to perform break-in of the instrument (e.g., break-in tones or frequencies).

The break-in tones or frequencies are applied to the instrument for a length of time, typically on the order of hours, or a day—perhaps more, depending on the number of peaks and the characteristic adaptability of the instrument to the break-in process. The break-in tones or frequencies are applied until a measured response to the break-in tones or frequencies is stable. That is, the instrument shows no change in response over a predetermined length of time, such as an hour, 2 hours, 4 hours, etc.

The break-in tones are preferably applied entirely in isolation, i.e., one and only one tone being applied to the instrument at any one time. However, variations in how break-in tones are applied (e.g., order time, synchronicity) may is acceptable. Further, it is preferable that none other than the identified peaks (e.g., tones approximately corresponding to the peaks) are applied during the break-in process—however, again, variations will and can be made without departing from the sprit and scope of the present invention.

The break-in tone may be applied in a rotating sequential manner. The tones may be applied from highest to lowest for short periods of times (e.g., 1 minute, 4 minutes, 8 minutes at a time, or other time periods) and then rotated back to the highest once the lowest has been reached (or vice versa). The amount of time spent at any one tone may be varied.

The tones may be applied in frequencies in order from lowest to highest, but other orders (such as highest to lowest) may be utilized. Application may also be performed in patterns such as alternating Low-Mid-High-Mid-Low, or Low Low, Mid Mid, High High, etc. Also, the length of time at each frequency in an alternating pattern may be varied. Such variation may, for example, mirror the relative strength or weaknesses in their corresponding peaks or other features from which the frequencies were derived. And, some advantage may be gained by varying the application as described above or by repeating in incremental steps starting with one tone at an end of the peak frequency spectrums and alternating incremental steps toward the opposite end in a pattern that, for example applies the end tone for a short duration (e.g., 30 seconds) increments (or decrements) the tone to the next adjacent frequency peak for a time (e.g., 10 seconds) and switches back to the original tone for, for example, a longer time (e.g., 60 seconds). Such and incremental up and down gradually increasing the length of time the tone is applied and incrementally adding tones. And, some advantage may be gained by varying the application as described above or by repeating in incremental steps starting with one tone at an end of the peak frequency spectrums and alternating incremental steps toward the opposite end in a pattern that, for example applies the end tone for a short duration (e.g., 30 seconds) increments (or decrements) the tone to the next adjacent frequency peak for a time (e.g., 10 seconds) and switches back to the original tone for, for example, a longer time (e.g., 60 seconds). Such and incremental up and down gradually increasing the length of time the tone is applied and incrementally adding tones.

All the methods of determining peaks may be utilized in any and all embodiments of the present invention. The skilled artisan can readily pick and choose between the methods or devise other methods that are intended to be applied to all embodiments or other aspects of the invention as described here in their equivalents all of which the skilled artisan understands in light of the present disclosure. The peak may be determined by using software modules or programs designed to find peaks in electrical or acoustical signals and applying them to the instrument's measured response.

The smoothed curve may be determined by using a filter that utilizes a weighted average over a predetermined number of cycles weighting closer cycles more heavily than farther cycles.

The present invention includes a method comprising applying a vibration or tone to a string instrument; reading a natural frequency response of the string instrument; identifying peaks in the natural frequency response; applying a vibration corresponding to the identified peaks. In one embodiment, the vibration is generated via a bridge vibrator. In one embodiment, the vibration is generated by speakers. In one embodiment, the vibration is generated via a piezo electric device. In one embodiment, the vibration is generated via a bridge mounted device. In one embodiment, the vibration is generated via a transducer mounted to any part of the instrument, including a bottom plate, top plate, side, bridge, fingerboard, nut, etc. Any and all methods or devices that may be utilized to apply vibrations to the instrument may interchanged with each other embodiment described herein.

Although the present invention is mainly directed to, and is preferably performed, using a single bridge vibrator attached to the bridge of the string instrument, the invention includes the use of multiple vibration devices operating at the same time on the same instrument. For example, two bridge vibrators attached to the bridge.

The present invention includes a production, comprising an instrument or set of instruments having been "woken-up" according to the present invention, and a performance by the instrument or set of instrument.

The present invention includes a method of waking up a Bow String Instrument (BSI), comprising the steps of determining at least one frequency response peak of the BSI, and applying a break-in vibration to the BSI instrument at or around the at least one frequency response peak. The method may include measuring a response of the BSI to the break-in vibration, and utilizing the measured response to determine a break-in state of the BSI, and repeating the steps of applying and measuring until the measured response has plateaued.

The method may include changing the break-in frequency to another of the at least one frequency response peak. The method may include changing to another break-in frequency. The method may include using the broke-in instrument in a performance. The performance may include where the broken-in instrument includes at least one solo.

The method may include wherein the at least one frequency response peak comprises a plurality of frequency response peaks in a lower frequency range of the BSI. The at least one frequency response peak may comprise, for example, a plurality of frequency response peaks at or below 500 Hz.

The method may further include a measurement of a response of the BSI to the break-in vibration, and utilizing the measured response to determine a break-in state of the BSI.

The method is complete, for example, after the measured response to the break-in frequencies, tones, or vibrations, becomes stable. Alternatively, for example, the method is complete when the measured response shows no variation or less than 1% variation over a predetermined time period of either 10, 20, 30, 40, 50, or 60 minutes. The predetermined time period could be 1 hour, 2 hours, 3 hours or more. Yet further alternatively, for example, the method is complete when a response to the applied vibration is stable or does not exhibit change over a predetermined time interval. The time interval may be, for example, 1 hour.

The at least one frequency response peak may comprise at least one high point in a frequency response of the BSI when responding to a test vibration from between 1 and 500 Hz. The frequency response of the BSI may be, or may comprise, volume.

Determining the at least one frequency response peak may comprise applying a range of vibrations to the BSI and measuring a response of the BSI across the range of vibrations and determining frequency response peaks from the measured response. The frequency response peaks may, for example, comprise regions of the measured response that have a higher volumetric response than immediately surrounding regions. The regions may comprise increments of approximately 100 Hz.

The steps of determining, applying, and measuring may be automated. The steps of applying and measuring may be automated and may be repeated.

The present invention includes a BSI manufacturing facility comprising a set of equipment configured to perform any of the methods or any combination of steps of the methods or processes described herein. The present invention includes a BSI constructed in a process incorporating any method or portion of any method or process described herein.

The present invention may comprise a process comprising the steps of determining peak response frequencies of an acoustical device, applying input stimulus corresponding to the peak response frequencies, measuring (over time) the acoustical device's response to the applied input stimulus, and completing the method when the measured response is stable.

In general, order is important, and in one embodiment, the invention may be described in steps, such as: (1) insure that the sound post is fully engaged, e.g., no air gaps—so that the top and bottom plates are solidly coupled; (2) insure that the bridge feet are also completely landed on the top plate and is at the correct angle (e.g., flush); (3) Apply vibrations (e.g., from a bridge vibrator); (4) bridge tuning to take full advantage of the now "woken-up" instrument; and (5) playing the instrument. The vibrations applied are, for example, corresponding to points of resonance (or frequency response peaks) of the instrument.

Figure 4:
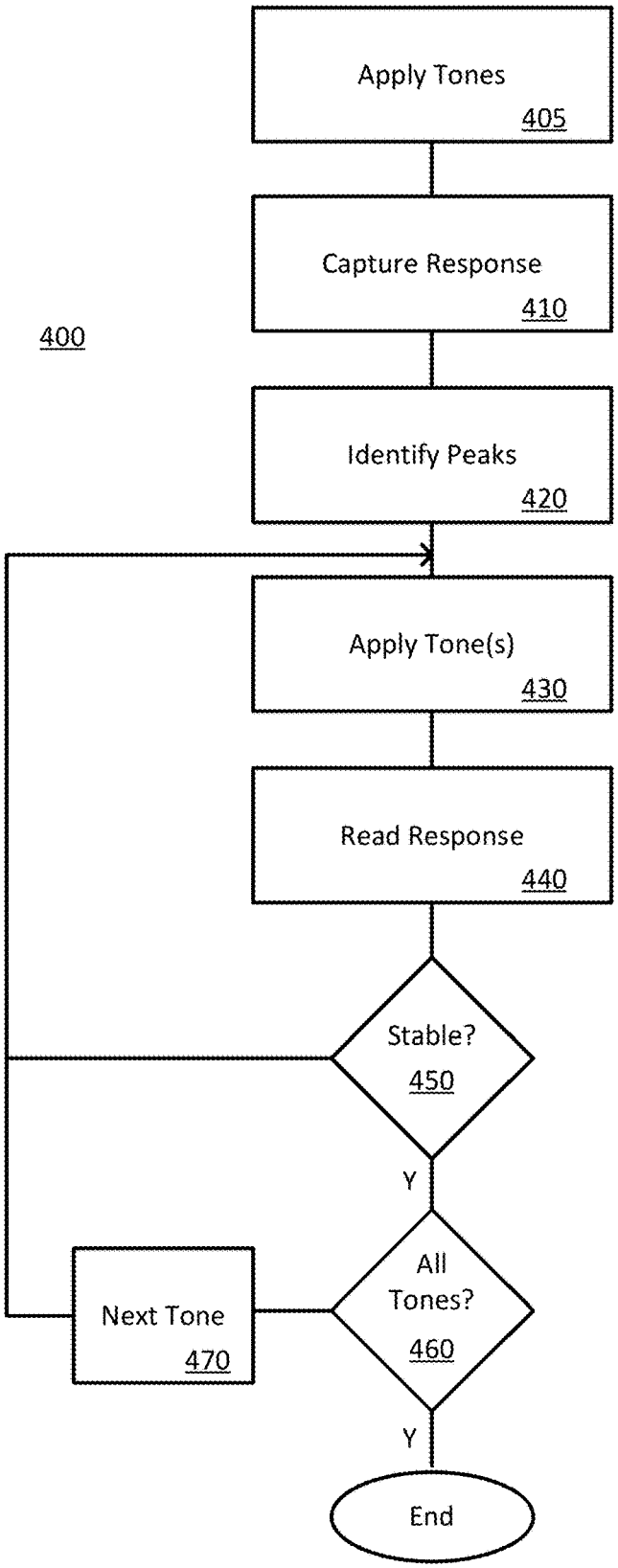
FIG. 4 is a flow chart illustrating a process according to various embodiments of the present invention.

FIG. 4 is a flow chart illustrating an overall process 400 according to various embodiments of the present invention. A preliminary step includes determining the soundness of an instrument or other acoustical device, and fixing any problems such as loose components (soundboard, plates, etc.). This is desirable because subsequent measurements will more accurately reflect the natural resonances of the instrument and because loose or mal-fitted components may cause damage to the instrument during measurement or application of break-in tones/vibrations.

The process begins in earnest by the application of tones to evaluate the natural resonances of the instrument, step 405. The tone application may be, for example, a steadily increasing vibration from 50 Hz to 1000 Hz. An example of application of a progressive 50 to 1000 Hz tone as applied to a violin and then captured is illustrated in FIG. 5A.

A response is captured, step 410. The captured response is, for example, a reading of the instrument's response from, for example, a spectrum analyzer. Step 410 may be accomplished by recording the sound of the instrument while the tones are being applied and then analyzing the recording, or directly inputting the instrument's response sound into an analyzer. Computer programs, for example, those discussed above, are well suited for this task/step.

A response graph as shown in FIG. 5A is a graph produced from the response of a violin instrument as the applied tones progress from 50 Hz to 1000 Hz. The response shown is from a progressive low-to-high tone application, but the invention can be performed with the application of tones in any manner (e.g., low-to-high, high-to-low, various segments or random application of tones). The graph of the response, which, by example, shown in FIG. 5A provides a convenient way to visually observe the response and to select peaks, inflection points, or other interesting features in the response and use those features in crafting a break-in plan for the instrument.

At step 420, peaks on the response graph are identified. The identification may be made by reviewing a response graph, maybe automatically identified using software or computer programs configured to identify peaks. In addition to identifying peaks, other features, inflection points and the like may also be identified and utilized in the break-in process. Such peaks may be identified by software and performed on cloud based processing platforms that may be connected in real-time to other software and microphones (or other audio/vibration pick-ups) connected or otherwise coupled to the instrument and capable of transmitting data reflecting the instruments response to break-in tones. Such may be performed with microphones connected to a computing device that captures the electrical signals representative of the instruments response, record and/or store and/or forward the instruments recorded response (or data reflective of the recorded response) to an Internet or cloud based service for any and all processing associated with the present invention including capturing the instrument's natural response, identifying peaks or other interesting features, sending break-in tones or data representative of break-in tones back to the instrument (or rather equipment coupled to the instrument) to perform the break-in. For step 430, the remote server provides frequencies/tones that are to be applied to the instrument for break-in. The frequencies/tones may be applied individually over periods of time. Alternatively, the frequencies/tones may be applied in various combinations (e.g., in pairs, all together, in combinations of frequencies sharing a common denominator). In any event, at step 430, the tone or tones applied for any given break-in period are applied to the instrument.

At step 440, a response to the break-in tone(s) is read. The response over time will change as the instrument becomes further broken-in. The break-in tone response may be read individually as per application of individual break-in tones, or in combination(s) similar to how the tones are applied.

At step 450, it is determined if the response to the break-in tone(s) is stable. As noted above, as the instrument breaks-in, the response will change, but eventually stabilize. If the response to the break-in tone(s) is stable, break-in for that tone or set of tones is complete.

At step 460, if all break-in tones have been applied and their corresponding responses have stabilized, the instrument is considered complete. If not, a next tone or set of tones (step 470) is then applied in loop fashion (looping back to step 430 with the next tone(s)).

When the response to all break-in tones have stabilized, the process is completed. However, a final step to bring the instrument to a full break-in and wake-up status, and highly recommended prior to performance tuning, is to play the instrument for a few minutes (e.g., play for 20 minutes). This step is optional for the luthier, and the broken-in woken-up instrument may be sent to its owner or retail outlet without being played.

Figure 5B:
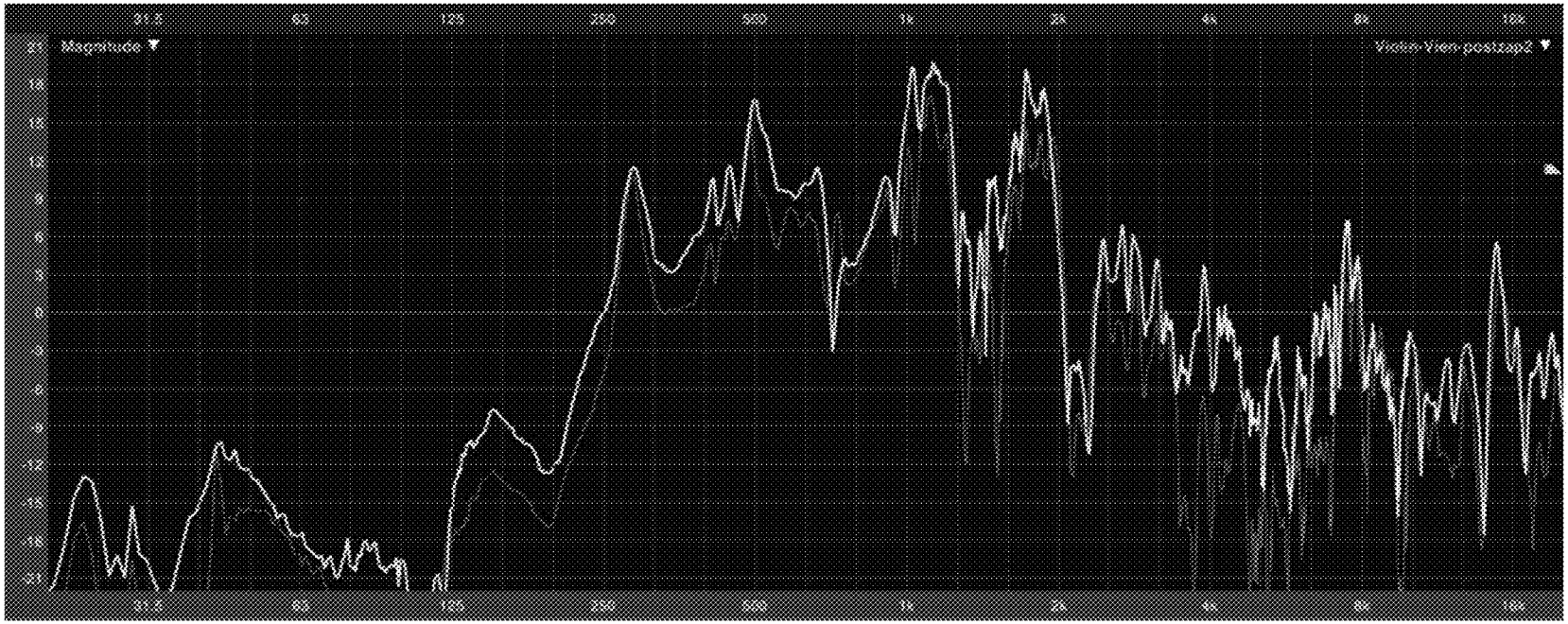
FIG. 5B is a chart of a measured response of the newly manufactured violin of FIG. 5A after application of the present invention.

FIG. 5B is an illustration of the after break-in response of the violin initially measured and recorded in FIG. 5A after applying the present invention. As can be seen by comparing FIG. 5B to FIG. 5A, the response has substantially changed. Also in comparison, the instrument plays with a sound that is unexpectedly refined and clearly woken-up compared to its former, but still respectable, response.

Although the present invention has been mainly described herein with reference to the violin and viola, the devices and processes of the present invention may be applied to other instrument or acoustical devices, including all bowed string instruments (cello, bass, etc.) that rely to any extent on vibrating materials like plates or other configurations. And the same or suitably modified processes my by applied to non-instrumental devices that have like or similar vibrational requirements or issues.

In various embodiments, the present invention may comprise a process of waking up a Bow String Instrument (BSI), which includes determining at least one frequency response peak of the BSI and applying a break-in vibration to the BSI instrument at (or near) the at least one frequency response peak. The at least one frequency response peak may comprise, for example, a plurality of frequency response peaks in a lower frequency range of the BSI. The at least one frequency response peak may comprise a plurality of frequency response peaks at or below 500 Hz. The process may further comprise measuring a response of the BSI to the break-in vibration, and utilizing the measured response to determine a break-in state of the BSI. The various actions of the process may be repeated, such as repeatedly applying and measuring until the measured amplitude response is stable.

In various embodiments, a process according to the invention may be completed when a measured response shows no variation or less than a predetermined amount of variation over a predetermined time period. Such amount may be a percentage, such as 1%, and said time frame may be, for example, an hour, approximately one hour, several hours, a day, or another time period.

The at least one frequency response peak may comprise at least one high point in a frequency response of the BSI when responding to a test vibration from between 1 and 500 Hz. The frequency response of the BSI may comprise volume.

Determining at least one frequency response peak may comprise applying a range of vibrations to the BSI and measuring a response of the BSI across the range of vibrations and determining the frequency response peak from the measured response(s). The frequency response peaks may comprise, or example, regions of the measured response that have a higher volumetric response than immediately surrounding regions. The regions comprise predetermined increments, the increments may be, for example, increments of approximately 100 Hz.

The various steps of any process according to the invention may be automated and repeated.

The invention may comprise, for example, any of the above steps or processes implemented in a manufacturing environment. The invention may comprise a facility comprising a set of equipment configured to perform the method according to any of the above steps and/or processes.

The invention includes a performance comprising at least one BSI, wherein the at least one BSI has been subjected to break-in according to any of steps or processes described here. The invention includes a performance comprising at least one BSI, wherein the at least one BSI has been subjected to break-in that includes measurement of frequency response peaks and application of the same or near same frequencies as the response peaks.

The invention includes a manufacturing process or facility including or configured to include any process according to the invention. The invention includes a manufacturing process or facility including or configured to measure frequency response peaks of a BSI and apply the same, near same, or approximately same frequencies in a manner that breaks-in the BSI. The invention includes any BSI subjected to vibrations of frequencies in an organized manner that specifically target natural harmonics of the BSI.

The invention includes a method comprising the steps of determining peak response frequencies of an acoustical device, applying input stimulus corresponding to the peak response frequencies, measuring the acoustical device's response to the applied input stimulus (the measurement(s) may be made over time), and completing the method when the measured response is stable. The present invention includes any BSI subjected to this method or an equivalent stimulus of peak response frequencies.

The present invention includes a method according to any of the Claim below, and in particular any of claims 1-14, wherein the steps of applying and measuring are automated and repeated. The present invention includes a BSI manufacturing facility comprising a set of equipment configured to perform a method according to any of the claims below including any of claims 1-16.

The present invention includes a performance comprising at least one BSI, wherein the BSI has been subjected to break-in according to any of the claims below, including any of claims 1-16. The present invention includes a Bow String Instrument (BSI) constructed in a process comprising any of the claims below including any of claims 1-16.

The present invention includes a computer readable media and a set of instructions stored by the computer readable media that, when loaded into a computer, cause the computer to perform the steps of applying a break-in vibration to a Bow String Instrument (BSI) at the at least one frequency response peak, measuring a response of the BSI to the break-in vibration, and utilizing the measured response to determine a break-in state of the BSI.

In describing preferred embodiments of the present invention illustrated in the drawings, specific terminology is employed for the sake of clarity. However, the present invention is not intended to be limited to any of the specific terminology so selected, and it is to be understood that each specific element includes all technical equivalents which operate in a similar manner. For example, when describing a bridge vibrator, any device capable of imparting vibration to the bridge or the instrument as a whole, or any other equivalent device, such as a vibrator applied in other arts (not specifically adapted for bridge vibrating) or devices for imparting vibrations (including sound) from a distance or in proximity to the instrument of acoustical device, or other device having an equivalent function or capability, whether or not listed herein, may be substituted therewith. Furthermore, the inventor recognizes that newly developed technologies not now known may also be substituted for the described parts and still not depart from the scope of the present invention. All other described items, including, but not limited to microphones, smart phones, frequency analyzers, applications (apps on smart devices), computer programs, frequency analyzers, etc. should also be considered in light of any and all available equivalents.

Portions of the present invention may be conveniently implemented using a conventional general purpose or a specialized digital computer or microprocessor (e.g., smart phone) programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/–, micro-drive, and magneto-optical disks, ROMs, RAMs, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data. Such storage medium includes one or more app stores such as the Apple App store or Google Play.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications. Ultimately, such computer readable media further includes software for performing the present invention, as described above.

Included in the programming (software) of the general/specialized computer or microprocessor are software modules for implementing the teachings of the present invention, including, but not limited to, application of tones or frequencies to an external device, such as a bridge vibrator, recording of sounds, such as instrumental sounds emanating in response to applied tones, capturing data representative of the sounds, analyzing the captured sounds or data to identify peaks, inflection points, and/or other features in the responsive sounds; application of break-in tones corresponding to the peaks or other features in the responsive sounds, monitoring response to break-in tones and particularly changes in the response, and the display, storage, or communication of results according to the processes of the present invention.

The present invention may suitably comprise, consist of, or consist essentially of, any of element (the various parts or features of the invention, e.g., microphones, pickups, frequency analyzers, software for capture or analysis of sound, cables (or non-cable coupling methods or wireless communications between any of the components of the invention) and their equivalents as described herein. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

The present invention includes a computer readable media and a set of instructions stored by the computer readable media that, when loaded into a computer, cause the computer to perform the steps of applying a break-in vibration to a Bow String Instrument (BSI) at the at least one frequency response peak; measuring a response of the BSI to the break-in vibration, and utilizing the measured response to determine a break-in state of the BSI.

The methods and processes of the present invention include applying and measuring, wherein measurement data is collected on-site (the site where the instrument is located), transmitting the recorded data to a remote site for processing (e.g., identification of peaks, and/or testing for stability). The remote site may send commands to control the onsite vibration device such as a bridge vibrator. Such measurements and commands may be coordinated via a computer program or smartphone application.

The present invention may be practiced via remotely connected components or in a stand-alone mode where all data and processing remains in the same locale as the instrument being broken-in. The present invention may be practiced by individual luthiers in a shop or could be adapted to a manufacturing facility of, for example, student or professional instruments.

What is claimed and desired to be secured by Letters Patent of the united states is:

1. A method of waking up a Bow String Instrument (BSI), comprising the steps of:

determining at least one frequency response peak of the BSI; and applying a primarily non-acoustical break-in vibration to the BSI instrument at or near the at least one frequency response peak;

wherein the non-acoustical break-in vibration is transmitted to the BSI through a primarily vibrational pathway utilized by the BSI when it is being played.

2. The method according to claim 1, wherein the at least one frequency response peak comprises a plurality of frequency response peaks in a lower frequency range of the BSI.

3. The method according to claim 1, wherein the at least one frequency response peak comprises a plurality of frequency response peaks at or below 500 Hz.

4. The method according to claim 1, further comprising the step of measuring a response of the BSI to the break-in vibration, and utilizing the measured response to determine a break-in state of the BSI.

5. The method according to claim 4, further comprising: repeating the steps of applying and measuring until the measured amplitude response is stable.

6. The method according to claim 4, wherein the method is completed after the measured amplitude response becomes stable.

7. The method according to claim 6, further comprising the step of ending the method when the measured response shows no variation or less than 1% variation over a predetermined time period.

8. The method according to claim 1, wherein the method is completed when a response to the applied vibration is stable or does not exhibit change over a predetermined time interval.

9. The method according to claim 8, wherein the time interval comprises approximately one hour.

10. The method according to claim 1, wherein the at least one frequency response peak comprises at least one high point in a frequency response of the BSI when responding to a test vibration from between 1 and 500 Hz.

11. The method according to claim 10, wherein the frequency response of the BSI comprises volume.

12. The method according to claim 1, wherein the step of determining at least one frequency response peak comprises applying a range of vibrations to the BSI and measuring an acoustic response of the BSI across the range of vibrations and determining the frequency response peak from the measured response.

13. The method according to claim 12, wherein the frequency response peaks comprise regions of the measured response that have a higher volumetric response than immediately surrounding regions.

14. The method according to claim 13, wherein the regions comprise increments of approximately 100 Hz.

15. The method according to claim 4, wherein the steps of determining, applying, and measuring are automated.

16. A performance comprising at least one BSI, wherein the BSI has been subjected to break-in according to claim 1.

17. A Bow String Instrument constructed in a process comprising claim 1.

18. A process, comprising the steps of:

determining peak response frequencies of an acoustical device;

applying input stimulus corresponding to the peak response frequencies;

over time, measuring the acoustical device's response to the applied input stimulus; and completing the method when the measured response is stable.

19. A bow string instrument subjected to the process according to claim 18.

20. A computer readable media and a set of instructions stored by the computer readable media that, when loaded into a computer, cause the computer to perform the steps of:

applying a break-in vibration to a Bow String Instrument (BSI) at the at least one frequency response peak into the BSI via a primarily non-acoustical vibrational pathway utilized by th BSI when it is being played;

measuring a response of the BSI to the break-in vibration;

utilizing the measured response to determine a break-in state of the BSI; and continuing to apply the break-in vibration until the measured response reaches a desired quality.

21. A method of waking up a Bow String Instrument (BSI), comprising the steps of:

determining a plurality of frequency response peaks of the BSI; and applying break-in vibrations to the BSI instrument via a mechanical coupling to the BSI;

wherein the break-in vibrations are at or near at least one of the plurality of frequency response peaks.

22. The method according to claim 21, wherein the plurality of frequency response peaks comprises at least 3 peaks at 600 Hz or less.

23. The method according to claim 21, wherein the break-in vibrations are derived from one or more BSI instruments and applied to a BSI of similar design.

* * * * *